US008256924B2

(12) United States Patent
Simon et al.

(10) Patent No.: US 8,256,924 B2
(45) Date of Patent: Sep. 4, 2012

(54) LED-BASED LIGHT HAVING RAPIDLY OSCILLATING LEDS

(75) Inventors: David L. Simon, Grosse Pointe Woods, MI (US); John Ivey, Farmington Hills, MI (US)

(73) Assignee: Ilumisys, Inc., Troy, MI (US)

( * ) Notice: Subject to any disclaimer, the term of this patent is extended or adjusted under 35 U.S.C. 154(b) by 246 days.

(21) Appl. No.: 12/210,653

(22) Filed: Sep. 15, 2008

(65) Prior Publication Data

US 2010/0067231 A1 Mar. 18, 2010

(51) Int. Cl.
*F21S 4/00* (2006.01)

(52) U.S. Cl. ..... 362/249.03; 362/225; 362/272; 362/286

(58) Field of Classification Search ..... 362/249.07, 362/269–275, 232–234, 249.11, 249.01–249.03, 362/35, 220, 221, 225, 227, 235, 236, 240, 362/249.1, 800, 217.01, 217.02, 217.08, 362/219, 249.09, 253, 254, 285–287, 498, 362/555, FOR. 103, FOR. 105; 313/498; 392/393

See application file for complete search history.

(56) References Cited

U.S. PATENT DOCUMENTS

| | | | | |
|---|---|---|---|---|
| 54,511 | A | | 2/1920 | Owen |
| 58,105 | A | | 6/1921 | Poritz |
| 79,814 | A | | 8/1929 | Hoch |
| 80,419 | A | | 1/1930 | Kramer |
| 84,763 | A | | 7/1931 | Stange |
| D119,797 | S | | 4/1940 | Winkler et al. |
| D125,312 | S | | 2/1941 | Logan |
| 2,826,679 | A | * | 3/1958 | Irmischer et al. ..... 362/269 |
| 2,909,097 | A | | 10/1959 | Alden et al. |
| 3,318,185 | A | | 5/1967 | Kott |
| 3,561,719 | A | | 2/1971 | Grindle |
| 3,586,936 | A | | 6/1971 | McLeroy |
| 3,601,621 | A | | 8/1971 | Ritchie |
| 3,612,855 | A | | 10/1971 | Juhnke |
| 3,643,088 | A | | 2/1972 | Osteen et al. |
| 3,739,336 | A | * | 6/1973 | Burland ..... 340/472 |
| 3,746,918 | A | | 7/1973 | Drucker et al. |
| 3,818,216 | A | | 6/1974 | Larraburu |
| 3,832,503 | A | | 8/1974 | Crane |
| 3,858,086 | A | | 12/1974 | Anderson et al. |
| 3,909,670 | A | | 9/1975 | Wakamatsu et al. |
| 3,924,120 | A | | 12/1975 | Cox, III |

(Continued)

FOREIGN PATENT DOCUMENTS

CN 1584388 A 2/2005

(Continued)

OTHER PUBLICATIONS

Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.

(Continued)

*Primary Examiner* — Y My Quach Lee
(74) *Attorney, Agent, or Firm* — Young Basile

(57) ABSTRACT

An LED-based light includes a support structure. At least one oscillator is connected to the support structure. At least one LED is coupled to each oscillator. The oscillator can oscillate the LED to produce a light blurring effect.

20 Claims, 3 Drawing Sheets

U.S. PATENT DOCUMENTS 3,958,885 A 5/1976 Stockinger et al.
3,974,637 A 8/1976 Bergey et al.
3,993,386 A 11/1976 Rowe
4,001,571 A 1/1977 Martin
4,054,814 A 10/1977 Fegley et al.
4,070,568 A 1/1978 Gala
4,082,395 A 4/1978 Donato et al.
4,096,349 A 6/1978 Donato
4,102,558 A 7/1978 Krachman
4,107,581 A 8/1978 Abernethy
4,189,663 A 2/1980 Schmutzer et al.
4,211,955 A 7/1980 Ray
4,241,295 A 12/1980 Williams, Jr.
4,271,408 A 6/1981 Teshima et al.
4,272,689 A 6/1981 Crosby et al.
4,273,999 A 6/1981 Pierpoint
4,298,869 A 11/1981 Okuno
4,329,625 A 5/1982 Nishizawa et al.
4,339,788 A 7/1982 White et al.
4,342,947 A 8/1982 Bloyd
4,344,117 A * 8/1982 Niccum ..... 362/249.1
4,367,464 A 1/1983 Kurahashi et al.
D268,134 S 3/1983 Zurcher
4,382,272 A 5/1983 Quella et al.
4,388,567 A 6/1983 Yamazaki et al.
4,388,589 A 6/1983 Molldrem, Jr.
4,392,187 A 7/1983 Bornhorst
4,394,719 A 7/1983 Moberg
4,420,711 A 12/1983 Takahashi et al.
4,455,562 A 6/1984 Dolan et al.
4,500,796 A 2/1985 Quin
4,581,687 A 4/1986 Nakanishi
4,597,033 A 6/1986 Meggs et al.
4,600,972 A 7/1986 MacIntyre
4,607,317 A 8/1986 Lin
4,622,881 A 11/1986 Rand
4,625,152 A 11/1986 Nakai
4,635,052 A 1/1987 Aoike et al.
4,647,217 A 3/1987 Havel
4,656,398 A 4/1987 Michael et al.
4,661,890 A 4/1987 Watanabe et al.
4,668,895 A 5/1987 Schneiter
4,675,575 A 6/1987 Smith et al.
4,682,079 A 7/1987 Sanders et al.
4,686,425 A 8/1987 Havel
4,687,340 A 8/1987 Havel
4,688,154 A 8/1987 Nilssen
4,688,869 A 8/1987 Kelly
4,695,769 A 9/1987 Schweickardt
4,698,730 A 10/1987 Sakai et al.
4,701,669 A 10/1987 Head et al.
4,705,406 A 11/1987 Havel
4,707,141 A 11/1987 Havel
D293,723 S 1/1988 Buttner
4,727,289 A 2/1988 Uchida
4,740,882 A 4/1988 Miller
4,748,545 A 5/1988 Schmitt
4,753,148 A 6/1988 Johnson
4,758,173 A 7/1988 Northrop
4,771,274 A 9/1988 Havel
4,780,621 A 10/1988 Bartleucci et al.
4,794,383 A 12/1988 Havel
4,818,072 A 4/1989 Mohebban
4,824,269 A 4/1989 Havel
4,837,565 A 6/1989 White
4,843,627 A 6/1989 Stebbins
4,845,481 A 7/1989 Havel
4,845,745 A 7/1989 Havel
4,857,801 A 8/1989 Farrell
4,863,223 A 9/1989 Weissenbach et al.
4,870,325 A 9/1989 Kazar
4,874,320 A 10/1989 Freed et al.
4,887,074 A 12/1989 Simon et al.
4,894,832 A 1/1990 Colak
4,901,207 A 2/1990 Sato et al.
4,912,371 A 3/1990 Hamilton
4,922,154 A 5/1990 Cacoub
4,934,852 A 6/1990 Havel
4,941,072 A 7/1990 Yasumoto et al.
4,943,900 A 7/1990 Gartner
4,962,687 A 10/1990 Belliveau et al.
4,965,561 A 10/1990 Havel
4,973,835 A 11/1990 Kurosu et al.
4,979,081 A 12/1990 Leach et al.
4,980,806 A 12/1990 Taylor et al.
4,992,704 A 2/1991 Stinson
5,003,227 A 3/1991 Nilssen
5,008,595 A 4/1991 Kazar
5,008,788 A 4/1991 Palinkas
5,010,459 A 4/1991 Taylor et al.
5,018,054 A 5/1991 Ohashi et al.
5,027,037 A 6/1991 Wei
5,027,262 A 6/1991 Freed
5,032,960 A 7/1991 Katoh
5,034,807 A 7/1991 Von Kohorn
5,036,248 A 7/1991 McEwan et al.
5,038,255 A 8/1991 Nishihashi et al.
5,065,226 A 11/1991 Kluitmans et al.
5,072,216 A 12/1991 Grange
5,078,039 A 1/1992 Tulk et al.
5,083,063 A 1/1992 Brooks
5,088,013 A 2/1992 Revis
5,089,748 A 2/1992 Ihms
5,103,382 A 4/1992 Kondo et al.
5,122,733 A 6/1992 Havel
5,126,634 A 6/1992 Johnson
5,128,595 A 7/1992 Hara
5,130,909 A 7/1992 Gross
5,134,387 A 7/1992 Smith et al.
5,140,220 A 8/1992 Hasegawa
5,142,199 A 8/1992 Elwell
5,151,679 A 9/1992 Dimmick
5,154,641 A 10/1992 McLaughlin
5,161,879 A 11/1992 McDermott
5,161,882 A 11/1992 Garrett
5,164,715 A 11/1992 Kashiwabara et al.
5,184,114 A 2/1993 Brown
5,194,854 A 3/1993 Havel
5,198,756 A 3/1993 Jenkins et al.
5,209,560 A 5/1993 Taylor et al.
5,220,250 A 6/1993 Szuba
5,225,765 A 7/1993 Callahan et al.
5,226,723 A 7/1993 Chen
5,254,910 A 10/1993 Yang
5,256,948 A 10/1993 Boldin et al.
5,278,542 A 1/1994 Smith et al.
5,282,121 A 1/1994 Bornhorst et al.
5,283,517 A 2/1994 Havel
5,287,352 A 2/1994 Jackson et al.
5,294,865 A 3/1994 Haraden
5,298,871 A 3/1994 Shimohara
5,301,090 A 4/1994 Hed
5,303,124 A 4/1994 Wrobel
5,307,295 A 4/1994 Taylor et al.
5,321,593 A 6/1994 Moates
5,323,226 A 6/1994 Schreder
5,329,431 A 7/1994 Taylor et al.
5,344,068 A 9/1994 Haessig
5,350,977 A 9/1994 Hamamoto et al.
5,357,170 A 10/1994 Luchaco et al.
5,371,618 A 12/1994 Tai et al.
5,374,876 A 12/1994 Horibata et al.
5,375,043 A 12/1994 Tokunaga
D354,360 S 1/1995 Murata
5,381,074 A 1/1995 Rudzewicz et al.
5,388,357 A 2/1995 Malita
5,402,702 A 4/1995 Hata
5,404,282 A 4/1995 Klinke et al.
5,406,176 A 4/1995 Sugden
5,410,328 A 4/1995 Yoksza et al.
5,412,284 A 5/1995 Moore et al.
5,412,552 A 5/1995 Fernandes
5,420,482 A 5/1995 Phares
5,421,059 A 6/1995 Leffers, Jr.
5,430,356 A 7/1995 Ference et al.
5,432,408 A 7/1995 Matsuda et al.
5,436,535 A 7/1995 Yang 5,436,853 A 7/1995 Shimohara
5,450,301 A 9/1995 Waltz et al.
5,461,188 A 10/1995 Drago et al.
5,463,280 A 10/1995 Johnson
5,465,144 A 11/1995 Parker et al.
5,475,300 A 12/1995 Havel
5,481,441 A * 1/1996 Stevens ..... 362/35
5,489,827 A 2/1996 Xia
5,491,402 A 2/1996 Small
5,493,183 A 2/1996 Kimball
5,504,395 A 4/1996 Johnson et al.
5,506,760 A 4/1996 Giebler et al.
5,513,082 A 4/1996 Asano
5,519,496 A 5/1996 Borgert et al.
5,530,322 A 6/1996 Ference et al.
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
D376,030 S 11/1996 Cohen
5,575,459 A 11/1996 Anderson
5,575,554 A 11/1996 Guritz
5,581,158 A 12/1996 Quazi
5,592,051 A 1/1997 Korkala
5,600,199 A 2/1997 Martin, Sr. et al.
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,423 A 4/1997 Lee
5,633,629 A 5/1997 Hochstein
5,634,711 A 6/1997 Kennedy et al.
5,640,061 A 6/1997 Bornhorst et al.
5,640,141 A 6/1997 Myllymaki
5,642,129 A 6/1997 Zavracky et al.
5,655,830 A 8/1997 Ruskouski
5,656,935 A 8/1997 Havel
5,661,645 A 8/1997 Hochstein
5,673,059 A 9/1997 Zavracky et al.
5,682,103 A 10/1997 Burrell
5,688,042 A 11/1997 Madadi et al.
5,697,695 A 12/1997 Lin et al.
5,701,058 A 12/1997 Roth
5,712,650 A 1/1998 Barlow
5,721,471 A 2/1998 Begemann et al.
5,725,148 A 3/1998 Hartman
5,726,535 A 3/1998 Yan
5,731,759 A 3/1998 Finucan
5,734,590 A 3/1998 Tebbe
5,751,118 A 5/1998 Mortimer
5,752,766 A 5/1998 Bailey et al.
5,765,940 A 6/1998 Levy et al.
5,769,527 A 6/1998 Taylor et al.
5,784,006 A 7/1998 Hochstein
5,785,227 A 7/1998 Akiba
5,790,329 A 8/1998 Klaus et al.
5,803,579 A 9/1998 Turnbull et al.
5,803,580 A 9/1998 Tseng
5,803,729 A 9/1998 Tsimerman
5,806,965 A 9/1998 Deese
5,808,689 A 9/1998 Small
5,810,463 A 9/1998 Kawahara et al.
5,812,105 A 9/1998 Van de Ven
5,813,751 A 9/1998 Shaffer
5,813,753 A 9/1998 Vriens et al.
5,821,695 A 10/1998 Vilanilam et al.
5,825,051 A 10/1998 Bauer et al.
5,828,178 A 10/1998 York et al.
5,836,676 A 11/1998 Ando et al.
5,848,837 A 12/1998 Gustafson
5,850,126 A 12/1998 Kanbar
5,851,063 A 12/1998 Doughty et al.
5,852,658 A 12/1998 Knight et al.
5,854,542 A 12/1998 Forbes
RE36,030 E 1/1999 Nadeau
5,859,508 A 1/1999 Ge et al.
5,865,529 A 2/1999 Yan
5,890,794 A 4/1999 Abtahi et al.
5,896,010 A 4/1999 Mikolajczak et al.
5,907,742 A 5/1999 Johnson et al.
5,912,653 A 6/1999 Fitch
5,921,660 A 7/1999 Yu
5,924,784 A 7/1999 Chliwnyj et al.
5,927,845 A 7/1999 Gustafson et al.
5,934,792 A 8/1999 Camarota
5,946,209 A 8/1999 Eckel et al.
5,949,347 A 9/1999 Wu
5,952,680 A 9/1999 Strite
5,959,547 A 9/1999 Tubel et al.
5,962,989 A 10/1999 Baker
5,962,992 A 10/1999 Huang et al.
5,963,185 A 10/1999 Havel
5,974,553 A 10/1999 Gandar
5,980,064 A 11/1999 Metroyanis
5,998,925 A 12/1999 Shimizu et al.
5,998,928 A 12/1999 Hipp
6,007,209 A 12/1999 Pelka
6,008,783 A 12/1999 Kitagawa et al.
6,011,691 A 1/2000 Schreffler
6,016,038 A 1/2000 Mueller et al.
6,018,237 A 1/2000 Havel
6,019,493 A 2/2000 Kuo et al.
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
D422,737 S 4/2000 Orozco
6,056,420 A 5/2000 Wilson et al.
6,068,383 A 5/2000 Robertson et al.
6,069,597 A 5/2000 Hansen
6,072,280 A 6/2000 Allen
6,084,359 A 7/2000 Hetzel et al.
6,086,220 A 7/2000 Lash et al.
6,091,200 A 7/2000 Lenz
6,092,915 A 7/2000 Rensch
6,095,661 A 8/2000 Lebens et al.
6,097,352 A 8/2000 Zavracky et al.
6,116,748 A 9/2000 George
6,121,875 A 9/2000 Hamm et al.
6,127,783 A 10/2000 Pashley et al.
6,132,072 A 10/2000 Turnbull et al.
6,135,604 A 10/2000 Lin
6,139,174 A 10/2000 Butterworth
6,149,283 A 11/2000 Conway et al.
6,150,774 A 11/2000 Mueller et al.
6,151,529 A 11/2000 Batko
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
6,183,086 B1 2/2001 Neubert
6,183,104 B1 2/2001 Ferrara
6,184,628 B1 2/2001 Ruthenberg
6,196,471 B1 3/2001 Ruthenberg
6,203,180 B1 3/2001 Fleischmann
6,211,626 B1 4/2001 Lys et al.
6,215,409 B1 4/2001 Blach
6,217,190 B1 4/2001 Altman et al.
6,219,239 B1 4/2001 Mellberg et al.
6,227,679 B1 5/2001 Zhang et al.
6,238,075 B1 5/2001 Dealey, Jr. et al.
6,241,359 B1 6/2001 Lin
6,250,774 B1 6/2001 Begemann et al.
6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,292,901 B1 9/2001 Lys et al.
6,293,684 B1 9/2001 Riblett
6,297,724 B1 10/2001 Bryans et al.
6,305,109 B1 10/2001 Lee 6,305,821 B1 10/2001 Hsieh et al.
6,307,331 B1 10/2001 Bonasia et al.
6,310,590 B1 10/2001 Havel
6,323,832 B1 11/2001 Nishizawa et al.
6,325,651 B1 12/2001 Nishihara et al.
6,334,699 B1 1/2002 Gladnick
6,340,868 B1 1/2002 Lys et al.
6,354,714 B1 3/2002 Rhodes
6,361,186 B1 3/2002 Slayden
6,369,525 B1 4/2002 Chang et al.
6,371,637 B1 4/2002 Atchinson et al.
6,379,022 B1 4/2002 Amerson et al.
D457,667 S 5/2002 Piepgras et al.
D457,669 S 5/2002 Piepgras et al.
D457,974 S 5/2002 Piepgras et al.
6,388,393 B1 5/2002 Illingworth
6,394,623 B1 5/2002 Tsui
D458,395 S 6/2002 Piepgras et al.
6,400,096 B1 6/2002 Wells et al.
6,404,131 B1 6/2002 Kawano et al.
6,411,022 B1 6/2002 Machida
6,422,716 B2 7/2002 Henrici et al.
6,428,189 B1 8/2002 Hochstein
D463,610 S 9/2002 Piepgras et al.
6,445,139 B1 9/2002 Marshall et al.
6,448,550 B1 9/2002 Nishimura
6,448,716 B1 9/2002 Hutchison
6,459,919 B1 10/2002 Lys et al.
6,469,457 B2 10/2002 Callahan
6,471,388 B1 10/2002 Marsh
6,472,823 B2 10/2002 Yen
6,473,002 B1 10/2002 Hutchison
D468,035 S 12/2002 Blanc et al.
6,488,392 B1 12/2002 Lu
6,495,964 B1 12/2002 Muthu et al.
6,527,411 B1 3/2003 Sayers
6,528,954 B1 3/2003 Lys et al.
6,528,958 B2 3/2003 Hulshof et al.
6,538,375 B1 3/2003 Duggal et al.
6,548,967 B1 4/2003 Dowling et al.
6,573,536 B1 6/2003 Dry
6,577,072 B2 6/2003 Saito et al.
6,577,080 B2 6/2003 Lys et al.
6,577,512 B2 6/2003 Tripathi et al.
6,577,794 B1 6/2003 Currie et al.
6,578,979 B2 6/2003 Truttmann-Battig
6,582,103 B1 6/2003 Popovich et al.
6,583,550 B2 6/2003 Iwasa et al.
6,583,573 B2 6/2003 Bierman
6,585,393 B1 7/2003 Brandes et al.
6,586,890 B2 7/2003 Min et al.
6,590,343 B2 7/2003 Pederson
6,592,238 B2 7/2003 Cleaver et al.
6,596,977 B2 7/2003 Muthu et al.
6,598,996 B1 7/2003 Lodhie
6,608,453 B2 8/2003 Morgan et al.
6,608,614 B1 8/2003 Johnson
6,609,804 B2 8/2003 Nolan et al.
6,612,712 B2 9/2003 Nepil
6,612,717 B2 9/2003 Yen
6,621,222 B1 9/2003 Hong
6,623,151 B2 9/2003 Pederson
6,624,597 B2 9/2003 Dowling et al.
D481,484 S 10/2003 Cuevas et al.
6,634,770 B2 10/2003 Cao
6,634,779 B2 10/2003 Reed
6,636,003 B2 10/2003 Rahm et al.
6,639,349 B1 10/2003 Bahadur
6,641,284 B2 11/2003 Stopa et al.
6,659,622 B2 12/2003 Katogi et al.
6,660,935 B2 12/2003 Southard et al.
6,666,689 B1 12/2003 Savage, Jr.
6,667,623 B2 12/2003 Bourgault et al.
6,674,096 B2 1/2004 Sommers
6,676,284 B1 1/2004 Wynne Willson
6,679,621 B2 1/2004 West et al.
6,681,154 B2 1/2004 Nierlich et al.
6,682,205 B2 1/2004 Lin
6,683,419 B2 1/2004 Kriparos
6,700,136 B2 3/2004 Guida
6,712,486 B1 3/2004 Popovich et al.
6,717,376 B2 4/2004 Lys et al.
6,717,526 B2 4/2004 Martineau et al.
6,720,745 B2 4/2004 Lys et al.
6,726,348 B2 4/2004 Gloisten
6,741,324 B1 5/2004 Kim
D491,678 S 6/2004 Piepgras
D492,042 S 6/2004 Piepgras
6,744,223 B2 6/2004 Laflamme et al.
6,748,299 B1 6/2004 Motoyama
6,762,562 B2 7/2004 Leong
6,774,584 B2 8/2004 Lys et al.
6,777,891 B2 8/2004 Lys et al.
6,781,329 B2 8/2004 Mueller et al.
6,787,999 B2 9/2004 Stimac et al.
6,788,000 B2 9/2004 Appelberg et al.
6,788,011 B2 9/2004 Mueller et al.
6,791,840 B2 9/2004 Chun
6,796,680 B1 9/2004 Showers et al.
6,801,003 B2 10/2004 Schanberger et al.
6,806,659 B1 10/2004 Mueller et al.
6,814,470 B2 11/2004 Rizkin et al.
6,814,478 B2 * 11/2004 Menke ..... 362/499
6,815,724 B2 11/2004 Dry
6,846,094 B2 1/2005 Luk
6,851,816 B2 2/2005 Wu et al.
6,851,832 B2 2/2005 Tieszen
6,853,151 B2 2/2005 Leong et al.
6,853,563 B1 2/2005 Yang et al.
6,857,924 B2 2/2005 Fu et al.
6,860,628 B2 3/2005 Robertson et al.
6,866,401 B2 3/2005 Sommers et al.
6,869,204 B2 3/2005 Morgan et al.
6,871,981 B2 3/2005 Alexanderson et al.
6,874,924 B1 4/2005 Hulse et al.
6,879,883 B1 4/2005 Motoyama
6,882,111 B2 4/2005 Kan et al.
6,883,929 B2 4/2005 Dowling
6,883,934 B2 4/2005 Kawakami et al.
6,888,322 B2 5/2005 Dowling et al.
6,897,624 B2 5/2005 Lys et al.
6,909,239 B2 6/2005 Gauna
6,909,921 B1 6/2005 Bilger
6,918,680 B2 7/2005 Seeberger
6,921,181 B2 7/2005 Yen
6,936,968 B2 8/2005 Cross et al.
6,936,978 B2 8/2005 Morgan et al.
6,940,230 B2 9/2005 Myron et al.
6,948,829 B2 9/2005 Verdes et al.
6,957,905 B1 10/2005 Pritchard et al.
6,963,175 B2 11/2005 Archenhold et al.
6,964,501 B2 11/2005 Ryan
6,965,197 B2 11/2005 Tyan et al.
6,965,205 B2 11/2005 Piepgras et al.
6,967,448 B2 11/2005 Morgan et al.
6,969,179 B2 11/2005 Sloan et al.
6,969,186 B2 11/2005 Sonderegger et al.
6,969,954 B2 11/2005 Lys
6,975,079 B2 12/2005 Lys et al.
6,979,097 B2 12/2005 Elam et al.
6,982,518 B2 1/2006 Chou et al.
6,995,681 B2 2/2006 Pederson
6,997,576 B1 2/2006 Lodhie et al.
7,004,603 B2 2/2006 Knight
D518,218 S 3/2006 Roberge et al.
7,008,079 B2 3/2006 Smith
7,014,336 B1 3/2006 Ducharme et al.
7,015,650 B2 3/2006 McGrath
7,018,063 B2 3/2006 Michael et al.
7,021,799 B2 4/2006 Mizuyoshi
7,021,809 B2 4/2006 Iwasa et al.
7,024,256 B2 4/2006 Krzyzanowski et al.
7,031,920 B2 4/2006 Dowling et al.
7,033,036 B2 4/2006 Pederson
7,038,398 B1 5/2006 Lys et al.
7,038,399 B2 5/2006 Lys et al.
7,042,172 B2 5/2006 Dowling et al.
7,048,423 B2 5/2006 Stepanenko et al.

7,049,761 B2 5/2006 Timmermans et al.
7,052,171 B1 5/2006 Lefebvre et al.
7,053,557 B2 5/2006 Cross et al.
7,064,498 B2 6/2006 Dowling et al.
7,064,674 B2 6/2006 Pederson
7,067,992 B2 6/2006 Leong et al.
7,077,978 B2 7/2006 Setlur et al.
7,080,927 B2 7/2006 Feuerborn et al.
7,086,747 B2 8/2006 Nielson et al.
7,088,014 B2 8/2006 Nierlich et al.
7,088,904 B2 8/2006 Ryan, Jr.
7,102,902 B1 9/2006 Brown et al.
7,113,541 B1 9/2006 Lys et al.
7,114,830 B2 10/2006 Robertson et al.
7,114,834 B2 10/2006 Rivas et al.
7,118,262 B2 10/2006 Negley
7,119,503 B2 10/2006 Kemper
7,121,679 B2 10/2006 Fujimoto
7,122,976 B1 10/2006 Null et al.
7,128,442 B2 10/2006 Lee et al.
7,128,454 B2 10/2006 Kim et al.
D532,532 S 11/2006 Maxik
7,132,635 B2 11/2006 Dowling
7,132,785 B2 11/2006 Ducharme
7,132,804 B2 11/2006 Lys et al.
7,135,824 B2 11/2006 Lys et al.
7,139,617 B1 11/2006 Morgan et al.
7,144,135 B2 12/2006 Martin et al.
7,153,002 B2 12/2006 Kim et al.
7,161,311 B2 1/2007 Mueller et al.
7,161,313 B2 1/2007 Piepgras et al.
7,161,556 B2 1/2007 Morgan et al.
7,164,110 B2 1/2007 Pitigoi-Aron et al.
7,164,235 B2 1/2007 Ito et al.
7,165,863 B1 1/2007 Thomas et al.
7,165,866 B2 1/2007 Li
7,167,777 B2 1/2007 Budike, Jr.
7,168,843 B2 1/2007 Striebel
D536,468 S 2/2007 Crosby
7,178,941 B2 2/2007 Roberge et al.
7,180,252 B2 2/2007 Lys et al.
D538,950 S 3/2007 Maxik
D538,952 S 3/2007 Maxik et al.
D538,962 S 3/2007 Elliott
7,186,003 B2 3/2007 Dowling et al.
7,186,005 B2 3/2007 Hulse
7,187,141 B2 3/2007 Mueller et al.
7,190,126 B1 3/2007 Paton
7,192,154 B2 3/2007 Becker
7,198,387 B1 4/2007 Gloisten et al.
7,201,491 B2 4/2007 Bayat et al.
7,201,497 B2 4/2007 Weaver, Jr. et al.
7,202,613 B2 4/2007 Morgan et al.
7,204,615 B2 4/2007 Arik et al.
7,204,622 B2 4/2007 Dowling et al.
7,207,696 B1 4/2007 Lin
7,210,818 B2 5/2007 Luk et al.
7,210,957 B2 5/2007 Mrakovich
7,211,959 B1 5/2007 Chou
7,213,934 B2 5/2007 Zarian et al.
7,217,004 B2 5/2007 Park et al.
7,217,012 B2 5/2007 Southard et al.
7,217,022 B2 5/2007 Ruffin
7,218,056 B1 5/2007 Harwood
7,218,238 B2 5/2007 Right et al.
7,220,015 B2 5/2007 Dowling
7,220,018 B2 5/2007 Crabb et al.
7,221,104 B2 5/2007 Lys et al.
7,221,110 B2 5/2007 Sears et al.
7,224,000 B2 5/2007 Aanegola et al.
7,226,189 B2 6/2007 Lee et al.
7,228,052 B1 6/2007 Lin
7,228,190 B2 6/2007 Dowling et al.
7,231,060 B2 6/2007 Dowling et al.
7,233,115 B2 6/2007 Lys
7,233,831 B2 6/2007 Blackwell
7,236,366 B2 6/2007 Chen
7,237,924 B2 7/2007 Martineau et al.
7,237,925 B2 7/2007 Mayer et al.
7,239,532 B1 7/2007 Hsu et al.
7,241,038 B2 7/2007 Naniwa et al.
7,242,152 B2 7/2007 Dowling et al.
7,246,926 B2 7/2007 Harwood
7,246,931 B2 7/2007 Hsieh et al.
7,248,239 B2 7/2007 Dowling et al.
7,249,269 B1 7/2007 Motoyama
7,249,865 B2 7/2007 Robertson
D548,868 S 8/2007 Roberge et al.
7,252,408 B2 8/2007 Mazzochette et al.
7,253,566 B2 8/2007 Lys et al.
7,255,457 B2 8/2007 Ducharme et al.
7,255,460 B2 8/2007 Lee
7,256,554 B2 8/2007 Lys
7,258,458 B2 8/2007 Mochiachvili et al.
7,258,467 B2 8/2007 Saccomanno et al.
7,259,528 B2 8/2007 Pilz
7,262,439 B2 8/2007 Setlur et al.
7,264,372 B2 9/2007 Maglica
7,267,467 B2 9/2007 Wu et al.
7,270,443 B2 9/2007 Kurtz et al.
7,271,794 B1 9/2007 Cheng et al.
7,273,300 B2 9/2007 Mrakovich
7,274,045 B2 9/2007 Chandran et al.
7,274,160 B2 9/2007 Mueller et al.
D553,267 S 10/2007 Yuen
7,285,801 B2 10/2007 Eliashevich et al.
7,288,902 B1 10/2007 Melanson
7,296,912 B2 11/2007 Beauchamp
7,300,184 B2 11/2007 Ichikawa et al.
7,300,192 B2 11/2007 Mueller et al.
D556,937 S 12/2007 Ly
D557,854 S 12/2007 Lewis
7,303,300 B2 12/2007 Dowling et al.
7,306,353 B2 12/2007 Popovich et al.
7,307,391 B2 12/2007 Shan
7,308,296 B2 12/2007 Lys et al.
7,309,965 B2 12/2007 Dowling et al.
7,318,658 B2 1/2008 Wang et al.
7,319,244 B2 1/2008 Liu et al.
7,319,246 B2 1/2008 Soules et al.
7,321,191 B2 1/2008 Setlur et al.
7,326,964 B2 2/2008 Lim et al.
7,327,281 B2 2/2008 Hutchison
7,329,031 B2 2/2008 Liaw et al.
D563,589 S 3/2008 Hariri et al.
7,345,320 B2 3/2008 Dahm
7,348,604 B2 3/2008 Matheson
7,350,936 B2 4/2008 Ducharme et al.
7,350,952 B2 4/2008 Nishigaki
7,352,138 B2 4/2008 Lys et al.
7,352,339 B2 4/2008 Morgan et al.
7,353,071 B2 4/2008 Blackwell et al.
7,358,679 B2 4/2008 Lys et al.
7,358,929 B2 4/2008 Mueller et al.
7,374,327 B2 5/2008 Schexnaider
7,385,359 B2 6/2008 Dowling et al.
7,391,159 B2 6/2008 Harwood
7,396,146 B2 7/2008 Wang
7,401,935 B2 7/2008 VanderSchuit
7,401,945 B2 7/2008 Zhang
7,427,840 B2 9/2008 Morgan et al.
7,429,117 B2 9/2008 Pohlert et al.
7,434,964 B1 10/2008 Zheng et al.
7,438,441 B2 10/2008 Sun et al.
D580,089 S 11/2008 Ly et al.
D581,556 S 11/2008 To et al.
7,449,847 B2 11/2008 Schanberger et al.
D582,577 S 12/2008 Yuen
D584,428 S 1/2009 Li et al.
7,476,002 B2 1/2009 Wolf et al.
7,476,004 B2 1/2009 Chan
7,478,924 B2 1/2009 Robertson
D586,484 S 2/2009 Liu et al.
D586,928 S 2/2009 Liu et al.
7,490,957 B2 2/2009 Leong et al.
7,497,596 B2 3/2009 Ge
7,507,001 B2 3/2009 Kit
7,510,299 B2 3/2009 Timmermans et al.

7,520,635 B2 4/2009 Wolf et al.
7,521,872 B2 4/2009 Bruning
7,524,089 B2 4/2009 Park
D593,223 S 5/2009 Komar
7,534,002 B2 5/2009 Yamaguchi et al.
7,549,769 B2 6/2009 Kim et al.
7,556,396 B2 7/2009 Kuo et al.
7,559,663 B2 * 7/2009 Wong et al. ..... 362/35
7,572,030 B2 8/2009 Booth et al.
7,575,339 B2 8/2009 Hung
7,602,559 B2 10/2009 Jang et al.
7,619,366 B2 11/2009 Diederiks
7,635,201 B2 12/2009 Deng
D612,528 S 3/2010 McGrath et al.
7,690,813 B2 4/2010 Kanamori et al.
2001/0033488 A1 10/2001 Chliwnyj et al.
2001/0045803 A1 11/2001 Cencur
2002/0038157 A1 3/2002 Dowling et al.
2002/0044066 A1 4/2002 Dowling et al.
2002/0047569 A1 4/2002 Dowling et al.
2002/0047624 A1 4/2002 Stam et al.
2002/0047628 A1 4/2002 Morgan et al.
2002/0048169 A1 4/2002 Dowling et al.
2002/0057061 A1 5/2002 Mueller et al.
2002/0060526 A1 5/2002 Timmermans et al.
2002/0070688 A1 6/2002 Dowling et al.
2002/0074559 A1 6/2002 Dowling et al.
2002/0078221 A1 6/2002 Blackwell et al.
2002/0101197 A1 8/2002 Lys et al.
2002/0113555 A1 8/2002 Lys et al.
2002/0130627 A1 9/2002 Morgan et al.
2002/0145394 A1 10/2002 Morgan et al.
2002/0145869 A1 10/2002 Dowling
2002/0152045 A1 10/2002 Dowling et al.
2002/0152298 A1 10/2002 Kikta et al.
2002/0153851 A1 10/2002 Morgan et al.
2002/0158583 A1 10/2002 Lys et al.
2002/0163316 A1 11/2002 Lys et al.
2002/0171365 A1 11/2002 Morgan et al.
2002/0171377 A1 11/2002 Mueller et al.
2002/0171378 A1 11/2002 Morgan et al.
2002/0176259 A1 11/2002 Ducharme
2002/0179816 A1 12/2002 Haines et al.
2002/0195975 A1 12/2002 Schanberger et al.
2003/0011538 A1 1/2003 Lys et al.
2003/0028260 A1 2/2003 Blackwell
2003/0031015 A1 2/2003 Ishibashi
2003/0057884 A1 3/2003 Dowling et al.
2003/0057886 A1 3/2003 Lys et al.
2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten
2003/0189412 A1 10/2003 Cunningham
2003/0222587 A1 12/2003 Dowling, Jr. et al.
2004/0003545 A1 1/2004 Gillespie
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0105264 A1 6/2004 Spero
2004/0113568 A1 6/2004 Dowling et al.
2004/0116039 A1 6/2004 Mueller et al.
2004/0124782 A1 7/2004 Yu
2004/0130909 A1 7/2004 Mueller et al.
2004/0141321 A1 7/2004 Dowling et al.
2004/0145886 A1 * 7/2004 Fatemi et al. ..... 362/35
2004/0155609 A1 8/2004 Lys et al.
2004/0160199 A1 8/2004 Morgan et al.
2004/0178751 A1 9/2004 Mueller et al.
2004/0189218 A1 9/2004 Leong et al.
2004/0189262 A1 9/2004 McGrath
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0257007 A1 12/2004 Lys et al.
2005/0013133 A1 1/2005 Yeh
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0151489 A1 7/2005 Lys et al.
2005/0151663 A1 7/2005 Tanguay
2005/0154494 A1 7/2005 Ahmed
2005/0174473 A1 8/2005 Morgan et al.
2005/0174780 A1 8/2005 Park
2005/0184667 A1 8/2005 Sturman et al.
2005/0201112 A1 9/2005 Machi et al.
2005/0206529 A1 9/2005 St.-Germain
2005/0213320 A1 9/2005 Kazuhiro et al.
2005/0213352 A1 9/2005 Lys
2005/0213353 A1 9/2005 Lys
2005/0218838 A1 10/2005 Lys
2005/0218870 A1 10/2005 Lys
2005/0219860 A1 10/2005 Schexnaider
2005/0219872 A1 10/2005 Lys
2005/0225979 A1 10/2005 Robertson et al.
2005/0231133 A1 10/2005 Lys
2005/0236029 A1 10/2005 Dowling
2005/0236998 A1 10/2005 Mueller et al.
2005/0248299 A1 11/2005 Chemel et al.
2005/0253533 A1 11/2005 Lys et al.
2005/0259424 A1 11/2005 Zampini, II et al.
2005/0265019 A1 12/2005 Sommers et al.
2005/0275626 A1 12/2005 Mueller et al.
2005/0276051 A1 12/2005 Caudle et al.
2005/0276053 A1 12/2005 Nortrup et al.
2005/0276064 A1 12/2005 Wu et al.
2005/0285547 A1 12/2005 Piepgras et al.
2006/0002110 A1 1/2006 Dowling et al.
2006/0012987 A9 1/2006 Ducharme et al.
2006/0012997 A1 1/2006 Catalano et al.
2006/0016960 A1 1/2006 Morgan et al.
2006/0022214 A1 2/2006 Morgan et al.
2006/0028155 A1 2/2006 Young
2006/0028837 A1 2/2006 Mrakovich
2006/0034078 A1 2/2006 Kovacik et al.
2006/0050509 A9 3/2006 Dowling et al.
2006/0050514 A1 3/2006 Opolka
2006/0076908 A1 4/2006 Morgan et al.
2006/0092640 A1 5/2006 Li
2006/0098077 A1 5/2006 Dowling
2006/0104058 A1 5/2006 Chemel et al.
2006/0109648 A1 5/2006 Trenchard et al.
2006/0109649 A1 5/2006 Ducharme et al.
2006/0109661 A1 5/2006 Coushaine et al.
2006/0126325 A1 6/2006 Lefebvre et al.

2006/0126338 A1 6/2006 Mighetto
2006/0132061 A1 6/2006 McCormick et al.
2006/0132323 A1 6/2006 Grady, Jr.
2006/0146531 A1 7/2006 Reo et al.
2006/0152172 A9 7/2006 Mueller et al.
2006/0158881 A1 7/2006 Dowling
2006/0170376 A1 8/2006 Piepgras et al.
2006/0192502 A1 8/2006 Brown et al.
2006/0193131 A1 8/2006 McGrath et al.
2006/0197661 A1 9/2006 Tracy et al.
2006/0198128 A1 9/2006 Piepgras et al.
2006/0208667 A1 9/2006 Lys et al.
2006/0221606 A1 10/2006 Dowling et al.
2006/0221619 A1 10/2006 Nishigaki
2006/0232974 A1 10/2006 Lee et al.
2006/0262516 A9 11/2006 Dowling et al.
2006/0262521 A1 11/2006 Piepgras et al.
2006/0262544 A1 11/2006 Piepgras et al.
2006/0262545 A1 11/2006 Piepgras et al.
2006/0273741 A1 12/2006 Stalker, III
2006/0274529 A1 12/2006 Cao
2006/0285325 A1 12/2006 Ducharme et al.
2007/0035255 A1 2/2007 Shuster et al.
2007/0040516 A1 2/2007 Chen
2007/0041220 A1 2/2007 Lynch
2007/0047227 A1 3/2007 Ducharme
2007/0053182 A1 3/2007 Robertson
2007/0053208 A1 3/2007 Justel et al.
2007/0064419 A1 3/2007 Gandhi
2007/0064425 A1* 3/2007 Frecska et al. ..... 362/253
2007/0070621 A1 3/2007 Rivas et al.
2007/0070631 A1 3/2007 Huang et al.
2007/0081423 A1 4/2007 Chien
2007/0086754 A1 4/2007 Lys et al.
2007/0086912 A1 4/2007 Dowling et al.
2007/0097678 A1 5/2007 Yang
2007/0109763 A1 5/2007 Wolf et al.
2007/0115658 A1 5/2007 Mueller et al.
2007/0115665 A1 5/2007 Mueller et al.
2007/0120594 A1 5/2007 Balakrishnan et al.
2007/0127234 A1 6/2007 Jervey, III
2007/0133202 A1 6/2007 Huang et al.
2007/0139938 A1 6/2007 Petroski et al.
2007/0145915 A1 6/2007 Roberge et al.
2007/0147046 A1 6/2007 Arik et al.
2007/0152797 A1 7/2007 Chemel et al.
2007/0153514 A1 7/2007 Dowling et al.
2007/0159828 A1 7/2007 Wang
2007/0165402 A1 7/2007 Weaver, Jr. et al.
2007/0173978 A1 7/2007 Fein et al.
2007/0177382 A1 8/2007 Pritchard et al.
2007/0182387 A1 8/2007 Weirich
2007/0188114 A1 8/2007 Lys et al.
2007/0188427 A1 8/2007 Lys et al.
2007/0189026 A1 8/2007 Chemel et al.
2007/0195526 A1 8/2007 Dowling et al.
2007/0195527 A1 8/2007 Russell
2007/0195532 A1 8/2007 Reisenauer et al.
2007/0205712 A1 9/2007 Radkov et al.
2007/0206375 A1 9/2007 Piepgras et al.
2007/0211463 A1 9/2007 Chevalier et al.
2007/0228999 A1 10/2007 Kit
2007/0235751 A1 10/2007 Radkov et al.
2007/0236156 A1 10/2007 Lys et al.
2007/0237284 A1 10/2007 Lys et al.
2007/0240346 A1 10/2007 Li et al.
2007/0241657 A1 10/2007 Radkov et al.
2007/0242466 A1 10/2007 Wu et al.
2007/0247842 A1 10/2007 Zampini et al.
2007/0247847 A1 10/2007 Villard
2007/0247851 A1 10/2007 Villard
2007/0258231 A1 11/2007 Koerner et al.
2007/0258240 A1 11/2007 Ducharme et al.
2007/0263379 A1 11/2007 Dowling
2007/0274070 A1 11/2007 Wedell
2007/0281520 A1 12/2007 Insalaco et al.
2007/0285926 A1 12/2007 Maxik
2007/0285933 A1 12/2007 Southard et al.
2007/0290625 A1 12/2007 He et al.
2007/0291483 A1 12/2007 Lys
2007/0296350 A1 12/2007 Maxik et al.
2008/0003664 A1 1/2008 Tysoe et al.
2008/0007945 A1 1/2008 Kelly et al.
2008/0012502 A1 1/2008 Lys
2008/0012506 A1 1/2008 Mueller et al.
2008/0013316 A1 1/2008 Chiang
2008/0013324 A1 1/2008 Yu
2008/0018261 A1 1/2008 Kastner
2008/0037245 A1 2/2008 Chan
2008/0037284 A1 2/2008 Rudisill
2008/0055894 A1* 3/2008 Deng ..... 362/217
2008/0062680 A1 3/2008 Timmermans et al.
2008/0068838 A1* 3/2008 Galke et al. ..... 362/250
2008/0068839 A1* 3/2008 Matheson ..... 362/250
2008/0089075 A1 4/2008 Hsu
2008/0092800 A1 4/2008 Smith et al.
2008/0093615 A1 4/2008 Lin et al.
2008/0093998 A1 4/2008 Dennery et al.
2008/0094819 A1* 4/2008 Vaish ..... 362/35
2008/0094837 A1* 4/2008 Dobbins et al. ..... 362/249
2008/0130267 A1 6/2008 Dowling et al.
2008/0151535 A1 6/2008 de Castris
2008/0158871 A1 7/2008 McAvoy et al.
2008/0158887 A1 7/2008 Zhu et al.
2008/0164826 A1 7/2008 Lys
2008/0164827 A1 7/2008 Lys
2008/0164854 A1 7/2008 Lys
2008/0175003 A1 7/2008 Tsou et al.
2008/0180036 A1 7/2008 Garrity et al.
2008/0186704 A1 8/2008 Chou et al.
2008/0192436 A1 8/2008 Peng et al.
2008/0211419 A1 9/2008 Garrity
2008/0224629 A1 9/2008 Melanson
2008/0224636 A1 9/2008 Melanson
2008/0253125 A1 10/2008 Kang et al.
2008/0258647 A1 10/2008 Scianna
2008/0285257 A1 11/2008 King
2008/0290814 A1 11/2008 Leong et al.
2008/0291675 A1 11/2008 Lin et al.
2008/0298080 A1* 12/2008 Wu et al. ..... 362/555
2008/0315784 A1 12/2008 Tseng
2009/0002995 A1 1/2009 Lee et al.
2009/0016063 A1 1/2009 Hu
2009/0046473 A1 2/2009 Tsai et al.
2009/0052186 A1 2/2009 Xue
2009/0059557 A1* 3/2009 Tanaka ..... 362/35
2009/0067182 A1 3/2009 Hsu et al.
2009/0086492 A1 4/2009 Meyer
2009/0091938 A1 4/2009 Jacobson et al.
2009/0140285 A1 6/2009 Lin et al.
2009/0175041 A1 7/2009 Yuen et al.
2009/0185373 A1 7/2009 Grajcar
2009/0195186 A1 8/2009 Guest et al.
2009/0196034 A1 8/2009 Gherardini et al.
2009/0213588 A1 8/2009 Manes
2009/0273926 A1 11/2009 Deng
2009/0290334 A1* 11/2009 Ivey et al. ..... 362/219
2009/0303720 A1 12/2009 McGrath
2009/0316408 A1 12/2009 Villard
2010/0019689 A1* 1/2010 Shan ..... 315/294
2010/0027259 A1 2/2010 Simon et al.
2010/0033964 A1 2/2010 Choi et al.

FOREIGN PATENT DOCUMENTS

CN 2766345 Y 3/2006
CN 2869556 Y 2/2007
EP 0013782 B1 3/1983
EP 0091172 A2 10/1983
EP 0124924 B1 9/1987
EP 0174699 B1 11/1988
EP 0197602 B1 11/1990
EP 0214701 B1 3/1992
EP 0262713 B1 6/1992
EP 0203668 B1 2/1993
EP 0337567 B1 11/1993
EP 0390262 B1 12/1993
EP 0359329 B1 3/1994
EP 0403011 B1 4/1994

| | | | |
|---|---|---|---|
| EP | 0632511 | A2 | 1/1995 |
| EP | 0432848 | B1 | 4/1995 |
| EP | 0403001 | B1 | 8/1995 |
| EP | 0525876 | B1 | 5/1996 |
| EP | 0714556 | B1 | 1/1999 |
| EP | 0458408 | B1 | 9/1999 |
| EP | 0578302 | B1 | 9/1999 |
| EP | 0723701 | B1 | 1/2000 |
| EP | 0787419 | B1 | 5/2001 |
| EP | 1195740 | A2 | 4/2002 |
| EP | 1016062 | B1 | 8/2002 |
| EP | 1195740 | A3 | 1/2003 |
| EP | 1149510 | B1 | 2/2003 |
| EP | 1056993 | B1 | 3/2003 |
| EP | 0766436 | B1 | 5/2003 |
| EP | 0924281 | B1 | 5/2003 |
| EP | 0826167 | B1 | 6/2003 |
| EP | 1147686 | B1 | 1/2004 |
| EP | 1142452 | B1 | 3/2004 |
| EP | 1145602 | B1 | 3/2004 |
| EP | 1422975 | A1 | 5/2004 |
| EP | 0890059 | B1 | 6/2004 |
| EP | 1348319 | B1 | 6/2005 |
| EP | 1037862 | B1 | 7/2005 |
| EP | 1346609 | B1 | 8/2005 |
| EP | 1321012 | B1 | 12/2005 |
| EP | 1610593 | A2 | 12/2005 |
| EP | 1415517 | B1 | 5/2006 |
| EP | 1415518 | B1 | 5/2006 |
| EP | 1438877 | B1 | 5/2006 |
| EP | 1166604 | B1 | 6/2006 |
| EP | 1479270 | B1 | 7/2006 |
| EP | 1348318 | B1 | 8/2006 |
| EP | 1399694 | B1 | 8/2006 |
| EP | 1461980 | B1 | 10/2006 |
| EP | 1110120 | B1 | 4/2007 |
| EP | 1440604 | B1 | 4/2007 |
| EP | 1047903 | B1 | 6/2007 |
| EP | 1500307 | B1 | 6/2007 |
| EP | 0922305 | B1 | 8/2007 |
| EP | 0922306 | B1 | 8/2007 |
| EP | 1194918 | B1 | 8/2007 |
| EP | 1048085 | B1 | 11/2007 |
| EP | 1763650 | B1 | 12/2007 |
| EP | 1776722 | B1 | 1/2008 |
| EP | 1459599 | B1 | 2/2008 |
| EP | 1887836 | A2 | 2/2008 |
| EP | 1579733 | B1 | 4/2008 |
| EP | 1145282 | B1 | 7/2008 |
| EP | 1518445 | B1 | 5/2009 |
| EP | 1337784 | B1 | 6/2009 |
| GB | 2215024 | A | 9/1989 |
| GB | 2324901 | A | 11/1998 |
| JP | 6-54103 | U | 7/1994 |
| JP | H6-54103 | | 7/1994 |
| JP | 7-249467 | | 9/1995 |
| JP | 08-162677 | | 6/1996 |
| JP | 11-135274 | A | 5/1999 |
| JP | 2001-238272 | A | 8/2001 |
| JP | 2002-141555 | A | 5/2002 |
| JP | 3098271 | U | 2/2004 |
| JP | 2004-335426 | | 11/2004 |
| JP | 2005-158363 | A | 6/2005 |
| JP | 2005-166617 | A | 6/2005 |
| JP | 2005-347214 | A | 12/2005 |
| JP | 2006-507641 | A | 3/2006 |
| JP | 3139714 | U | 2/2008 |
| KR | 10-2004-0008244 | A | 1/2004 |
| KR | 20-0430022 | Y1 | 11/2006 |
| KR | 10-0781652 | B1 | 12/2007 |
| TW | M337036 | | 7/2008 |
| WO | 9906759 | A1 | 2/1999 |
| WO | 99/10867 | A1 | 3/1999 |
| WO | 99/31560 | A2 | 6/1999 |
| WO | 00/01067 | A2 | 1/2000 |
| WO | 02/25842 | A2 | 3/2002 |
| WO | 02/061330 | A2 | 8/2002 |
| WO | 02/069306 | A2 | 9/2002 |
| WO | 02/091805 | A2 | 11/2002 |
| WO | 02/098182 | A2 | 12/2002 |
| WO | 02/099780 | A2 | 12/2002 |
| WO | 03/026358 | A1 | 3/2003 |
| WO | 03/055273 | A2 | 7/2003 |
| WO | 03/067934 | A2 | 8/2003 |
| WO | 03/090890 | A1 | 11/2003 |
| WO | 03/096761 | A1 | 11/2003 |
| WO | 2004/021747 | A2 | 3/2004 |
| WO | 2004/023850 | A2 | 3/2004 |
| WO | 2004/032572 | A2 | 4/2004 |
| WO | 2004/100624 | A2 | 11/2004 |
| WO | 2005031860 | A2 | 4/2005 |
| WO | 2005/052751 | A2 | 6/2005 |
| WO | 2005/060309 | A2 | 6/2005 |
| WO | 2005/084339 | A2 | 9/2005 |
| WO | 2005/089293 | A2 | 9/2005 |
| WO | 2005/089309 | A2 | 9/2005 |
| WO | 2006/023149 | A2 | 3/2006 |
| WO | 2006044328 | A1 | 4/2006 |
| WO | WO 2006/056120 | A1 * | 6/2006 |
| WO | 2006/093889 | A2 | 9/2006 |
| WO | 2006/127666 | A2 | 11/2006 |
| WO | 2006/127785 | A2 | 11/2006 |
| WO | 2006/133272 | A2 | 12/2006 |
| WO | 2006137686 | A1 | 12/2006 |
| WO | 2007/081674 | A1 | 7/2007 |
| WO | 2007/094810 | A2 | 8/2007 |
| WO | 2007090292 | A1 | 8/2007 |
| WO | 2010/030509 | A2 | 3/2010 |

OTHER PUBLICATIONS

Experiment Electronic Ballast. Electronic Ballast for Fluorescent Lamps [online], Revised Fall of 2007. [Retrieved on Sep. 1, 1997]. Retrieved from Virginia Tech Web Page using Internet <URL: http://www.ece.vt.edu/ece3354/labs/ballast.pdf.>.

Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.

Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.

Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.

Telecite Products & Services—Display Options, [online], [retrieved on Jan. 13, 2000] Retrieved from Telecite Web page using Internet <URL: http://www.telecite.com/en/products/options en.htm>.

Traffic Signal Products—Transportation Products Group, [online], [retrieved on Jan. 13, 2000] Retrieved from the Dialight Web Page using Internet <URL: http://www.dialight.com/trans.htm>.

LED Lights, Replacement LED lamps for any incandescent light, [online], [retrieved on Jan. 13, 2000] Retrieved from LED Lights Web Page using Internet <URL: http://www.ledlights.com/replac.htm>.

LEDtronics, LEDtronics Catalog, 1996, p. 10, LEDtronics, Torrance, California.

Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi_qu3922/is_200005/ai_n8899499/>.

Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_building_systems/>.

Phason Electronic Control Systems, Light Level Controller (LLC) case study. Nov. 30, 2004. 3 pages, Phason Inc., Winnipeg, Manitoba, Canada.

Airport International. Fly High With Intelligent Airport Building and Security Solutions [online], [retrieved on Oct. 24, 2008]. Retrieved from Airport International web page using Internet <URL: http://www.airport-int.com/categories/airport-building-and-security-solutions/fly-high-with-intelligent-airport-building-and-security-solutions.html>.

Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/IBT_Archive/BNP_GUID_9-5-2006_A_10000000000000056772>.
Sensor Switch, nLight Lighting Control System, [online], [retrieved on Jan. 11, 2008] Retrieved from Sensor Switch web page using Internet <URL: http://www.sensorswitch.com>.
Six Strategies, [online], [retrieved on Jan. 11, 2008] Retrieved from Encelium Technologies Inc. Web Page using Internet <URL: http://www.enceliurn.com/products/strategies.html>.
Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tt/techs/lbnl1871.html>.
Best Practice Guide—Commercial Office Buildings—Central HVAC System. [online], [Retrieved on Jan. 17, 2008] Retrieved from Flex Your Power Organization web page using Internet <URL: http://www.fypower.org/bpg/module.html?b=offices&m+Central HVAC Systems&s=Contr...>.
Cornell University. Light Canopy—Cornell University Solar Decathlon, [online], [retrieved on Jan. 17, 2008] Retrieved from Cornell University web page using Internet <URL: http://cusd.cornell.edu/cusd/web/index.php/page/show/section/Design/page/controls>.
D.N.A.—III, [online], [retrieved Mar. 10, 2009] Retrieved from the PLC Lighting Web Page using Internet <URL: http://www.plclighting.com/product_info.php?cPath=1&products_id=92>.
E22201-44 Esprit Collection, [online],, [retrieved on Jul. 10, 2010] Retrieved from ET2 Contemporary Lighting using Internet <URL: http://www.et2online.com/proddetail.aspx?ItemID=E22201-44>.
E20116-18 Larmes Collection, [online], [retrieved on Jul. 10, 2010] Retrieved from ET2 Contemporary Lighting using Internet <URL: http://www.et2online.com/proddetail.aspx?ItemID=E20116-18>.
E20112-22 Starburst Collection, [online], [retrieved on Jul. 10, 2010] Retrieved from ET2 Contemporary Lighting using Internet <URL: http://www.et2online.com/proddetail.aspx?ItemID=E20112-22>.
E20743-09 Stealth Collection, [online], [retrieved on Jul. 10, 2010] Retrieved from ET2 Contemporary Lighting using Internet <URL: http://www.et2online.com/proddetail.aspx?ItemID=E20743-09>.
E20524-10 & E20525-10 Curva Collection, [online], [retrieved on Jul. 10, 2010] Retrieved from ET2 Contemporary Lighting using Internet <URL: http//www.et2online.com/proddetail.aspx?ItemID=E20524-10&20525-10>.

* cited by examiner

LED-BASED LIGHT HAVING RAPIDLY OSCILLATING LEDS

TECHNICAL FIELD

The invention relates to a light emitting diode (LED) based light, for example, an LED-based light usable in a fluorescent light fixture in place of a conventional fluorescent tube.

BACKGROUND

Fluorescent tubes are widely used in a variety of locations, such as schools and office buildings. Although conventional fluorescent tubes have certain advantages over, for example, incandescent lights, they also pose certain disadvantages including, inter alia, disposal problems due to the presence of toxic materials within the glass tube.

Tube shaped LED lights which can be used as one-for-one replacements for fluorescent tubes have appeared in recent years. Many LED-based lights shaped to replace fluorescent tubes are constrained by the directional light output of their LEDs, in contrast to the uniform non-directional light output of fluorescent tubes.

BRIEF SUMMARY

Oscillating an LED can reduce the appearance of point sources of light by producing a light blurring effect. In one example, an LED-based light is provided including a support structure, at least one oscillator connected to the support structure, and at least one LED coupled to each oscillator.

In another example, a replacement light for a conventional fluorescent tube usable in a fluorescent fixture is provided. The replacement light includes a support structure and at least one oscillator connected to the support structure. At least one LED is coupled to each oscillator, and at least one electrical connector at a longitudinal end of the support structure is in electrical communication with the at least one LED.

In yet another example, a method of distributing light produced by LEDs in an LED-based light usable in a fluorescent fixture is provided. The method includes providing at least one microelectromechanical system. The method also includes connecting the LEDs to the at least one microelectromechanical system and energizing the at least one microelectromechanical system during operation of the LEDs to move the LEDs at a sufficient speed to produce a light blurring effect.

BRIEF DESCRIPTION OF THE DRAWINGS

The description herein makes reference to the accompanying drawings wherein like reference numerals refer to like parts throughout the several views, and wherein.

DETAILED DESCRIPTION

FIGS. 1-9 illustrate examples of LED-based lights. In the example illustrated in FIG. 1, a light 10 is configured as a replacement for a fluorescent tube in a fluorescent fixture. The light 10 includes a housing 12, a circuit board 16 in the housing 12, multiple microelectromechanical systems (MEMS) 18 spaced along the circuit board 16, an LED 20 attached to each MEMS 18, and two bi-pin end caps 22.

Figure 1:
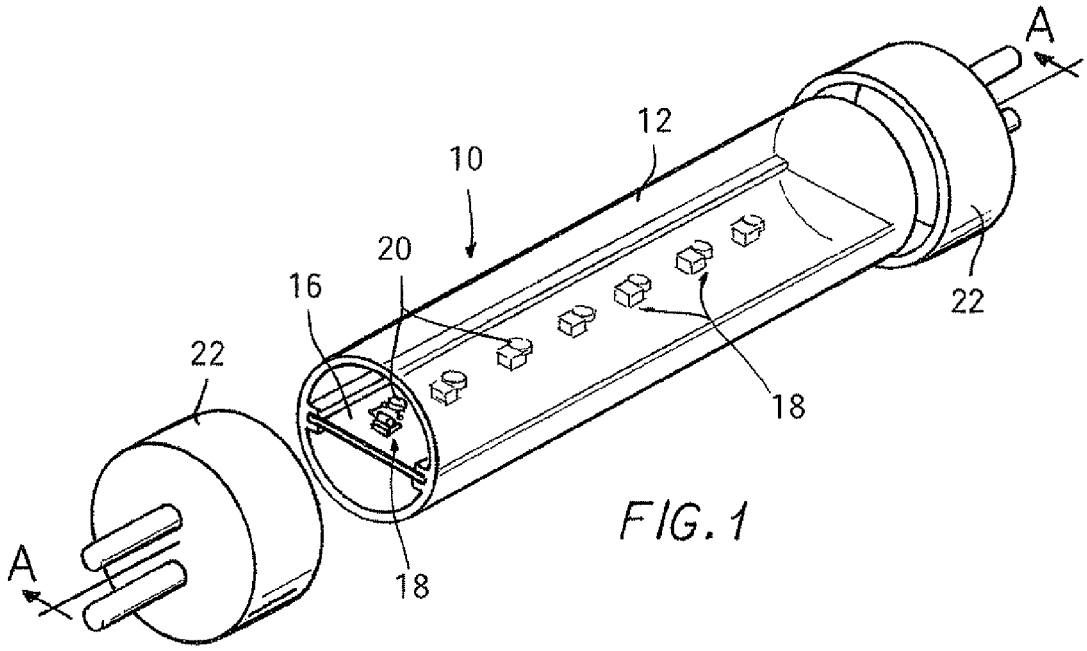
FIG. 1 is an exploded schematic of an example of an LED-based replacement light.

The housing 12 as shown in FIG. 1 is a light transmitting cylindrical tube. The housing 12 can be made from polycarbonate, acrylic, glass or another light transmitting material (i.e., the housing 12 can be transparent or translucent). For example, a translucent housing 12 can be made from a composite, such as polycarbonate with particles of a light refracting material interspersed in the polycarbonate. While the illustrated housing 12 is cylindrical, the housing 12 can alternatively have a square, triangular, polygonal, or other cross sectional shape. Similarly, while the illustrated housing 12 is linear, the housing 12 can have an alternative shape, e.g., a U-shape or a circular shape. Additionally, the housing 12 need not be a single piece as shown in FIG. 1. Instead, the housing 12 can be formed by attaching multiple individual parts, not all of which need be light transmitting. For example, the housing 12 can include a lower portion and a lens attached to the lower portion to cover the LEDs 20. The housing 12 can be manufactured to include light diffusing or refracting properties, such as by surface roughening or applying a diffusing film to the housing 12. The housing 12 can have a length such that the light 10 is approximately 48" long, and the housing 12 can have a 0.625", 1.0", or 1.5" diameter for engagement with common fluorescent fixtures.

The circuit board 16 as illustrated in FIG. 1 is an elongate printed circuit board. Multiple circuit board sections can be joined by bridge connectors to create the circuit board 16. The circuit board 16 as shown in FIG. 1 is slidably engaged with the housing 12, though the circuit board 16 can alternatively be clipped, adhered, snap- or friction-fit, screwed or otherwise connected to the housing 12. For example, the circuit board 16 can be mounted on a heat sink that is attached to the housing 12. Also, other types of circuit boards may be used, such as a metal core circuit board. Or, instead of a circuit board 16, other types of electrical connections (e.g., wires) can be used to electrically connect the MEMS 18 and/or LEDs 20 to a power source.

The LEDs 20 can be surface-mount devices of a type available from Nichia, though other types of LEDs can alternatively be used. For example, although surface-mounted LEDs 20 are shown, one or more organic LEDs can be used in place of or in addition thereto. The LEDs 20 can be mounted to the MEMS 18 as described above. The LEDs 20 can emit white light. However, LEDs that emit blue light, ultra-violet light or other wavelengths of light can be used in place of white light emitting LEDs 20.

The number of LEDs 20 can be a function of the desired power of the light 10 and the power of the LEDs 20. For a 48" light, such as the light 10, the number of LEDs 20 can vary from about five to four hundred such that the light 10 outputs approximately 500 to 3,000 lumens. However, a different number of LEDs 20 can alternatively be used, and the light 10 can output another amount of lumens. The LEDs 20 can be evenly spaced along the circuit board 16, and the spacing of the LEDs 20 can be determined based on, for example, the light distribution of each LED 20 and the number of LEDs 20.

Figure 2:
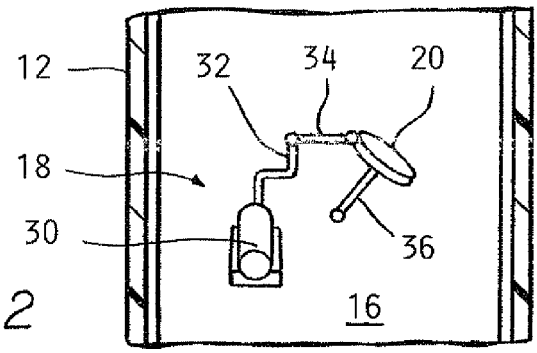
FIG. 2 is a schematic of an example of an oscillator.

As shown in FIG. 2, the MEMS 18 can include a motor 30, a cam 32, a link 34, and a lever 36. The motor 30 can be in electrical communication with the end caps 22. Alternatively, the motor 30 can be powered by another power source, e.g., a battery. The motor 30 can be a variable speed motor. The cam 32 can be coupled to the motor 30, either directly or through a transmission. The link 34 can couple the cam 32 to the lever 36, with opposing ends of the link 34 pivotally coupled to the cam 32 and lever 36 respectively. The lever 36 can be pivotally coupled to the circuit board 16. An LED 20 can be attached to the distal end of the lever 36, for example by adhering the LED 20 to the lever 36 or a snap-fit between the LED 20 and a platform at the distal end of the lever 36. However, the lever 36 and LED 20 can alternatively be attached to a support structure other than the circuit board 16, such as the housing 12, a heat sink, or a beam extending through the housing 12.

Figure 3A:
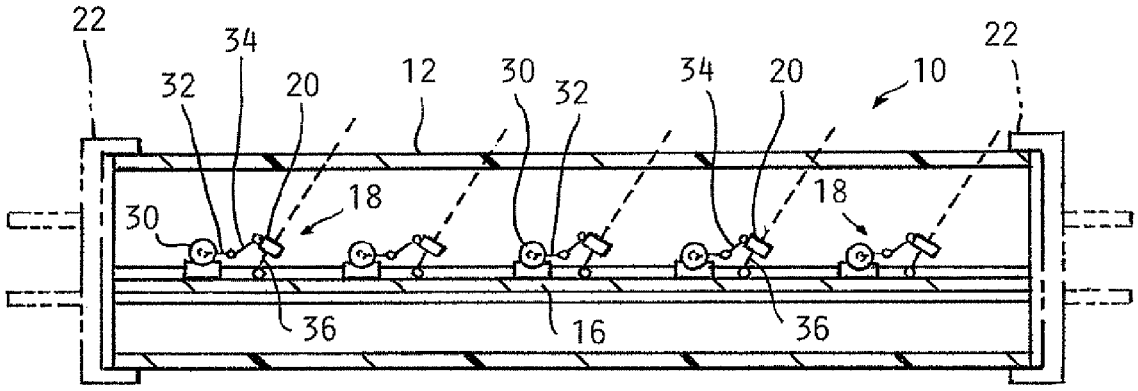
FIGS. 3A and 3B are a cross section view with LEDs in a first position and a partial cross section view with the LEDs in a second position, respectively, of the light of FIG. 1 along line A-A.
Figure 3B:
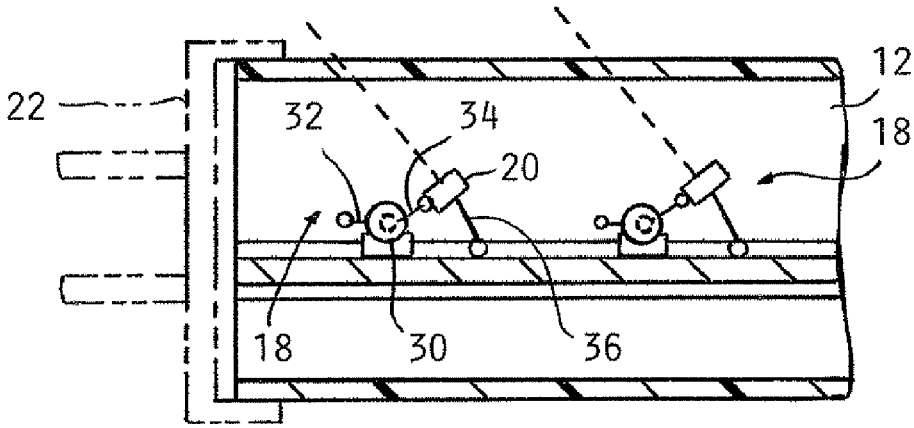

During operation, a current can be applied to the motor 30 to operate the motor 30 and rotate the cam 32. Rotation of the cam 32 can be transmitted to the lever 36 via the link 34. As a result, the distal end of the lever 36 can be oscillated between a first position shown in FIG. 3A and a second position as shown in FIG. 3B. The LEDs 20 can thus be oscillated parallel to a longitudinal axis of the housing 12, as obtaining a uniform distribution of light from LEDs 20 along a length of the housing 12 is often more difficult than obtaining a uniform distribution of light around an arc of the housing 12. However, the LEDs 20 can be oscillated in a different direction, e.g., perpendicular to the longitudinal axis of the housing 12. Also, the LEDs 20 can be oscillated to another position in addition to the first and second positions, e.g., the LEDs 20 can be oscillated in an L-shaped pattern including three positions or in a circular pattern as described in another example below including an infinite number of positions.

Figure 4:
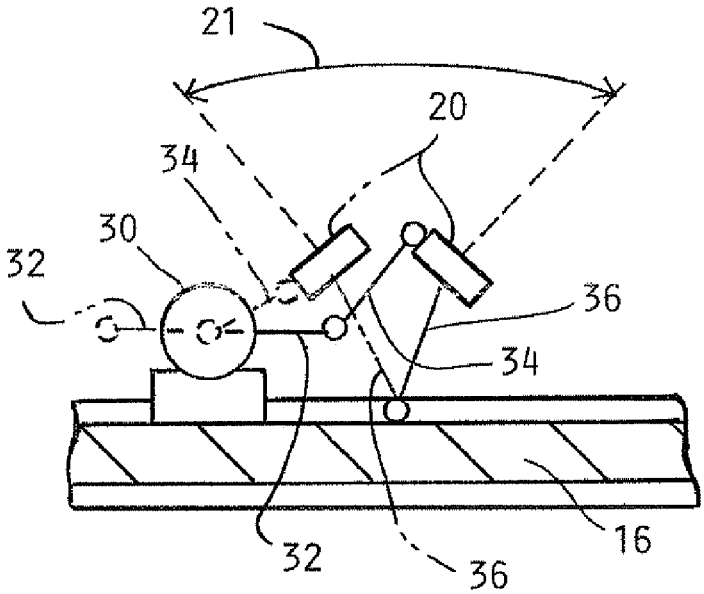
FIG. 4 is a partial cross section view the light of FIG. 1 along light A-A showing a distribution of light produced by the LEDs during oscillation, with the LED in the second position shown in phantom.

The speed of the motor 30 can be set high enough such that the LED 20 moves at a sufficiently rapid speed to produce a light blurring effect. That is, the LED 20 can be moved at a sufficiently high speed such that a human eye perceives the LED 20 as producing a larger distribution of light than if the LED 20 were stationary. Thus, by mounting the light on the MEMS 18 as shown in FIG. 2, the LED 20 can appear as a line of light 21 as shown in FIG. 4 extending between the LED 20 in the first position and the LED 20 shown in phantom in the second position.

Regarding the MEMS 18, structures are generally classified as microelectromechanical systems based on their size. For example, a structure smaller than a few millimeters in size (e.g., a structure less than a millimeter in length) can be deemed a microelectromechanical system. However, as used herein, the term "microelectromechanical system" is not intended to require any specific size limitation. That is, no bright line is intended between a structure that is small enough to be considered a microelectromechanical system and a structure that is not considered a microelectromechanical system. Instead, the term "microelectromechanical system" refers to a system having a size of similar magnitude to the size of the LED 20 attached thereto or smaller.

The light 10 can include two bi-pin end caps 22 (i.e., each end cap 22 can carry two pins), one at each longitudinal end of the housing 12, for physically and electrically connecting the light 10 to a fluorescent fixture. The end caps 22 can be electrically connected to the circuit board 16 to provide power to the MEMS 18 and LEDs 20. Each end cap 22 can include two pins, though two of the total four pins can be "dummy pins" that do not provide an electrical connection. Alternatively, other types of electrical connectors can be used, such as an end cap carrying a single pin. Also, while the end caps 22 are shown as including cup-shaped bodies, the end caps 22 can have a different configuration (e.g., the end caps 22 can be shaped to be press fit into the housing 12).

Figure 5:
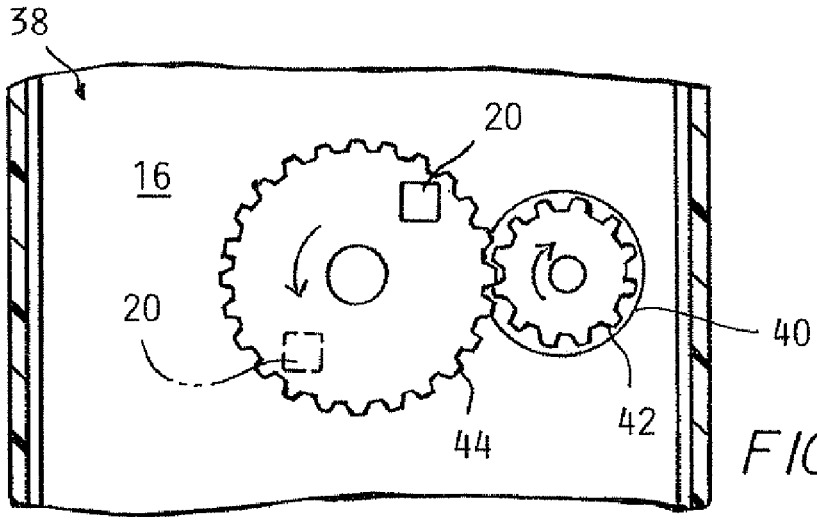
FIG. 5 is a partial schematic of another example of an oscillator.
Figure 6A:
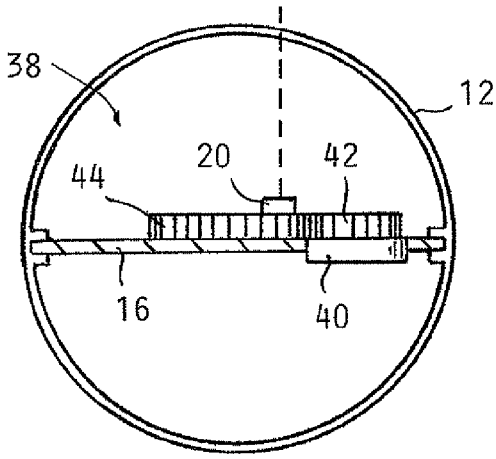
FIGS. 6A and 6B are end views of a housing of an example of an LED-based light including the oscillator of FIG. 5.
Figure 6B:
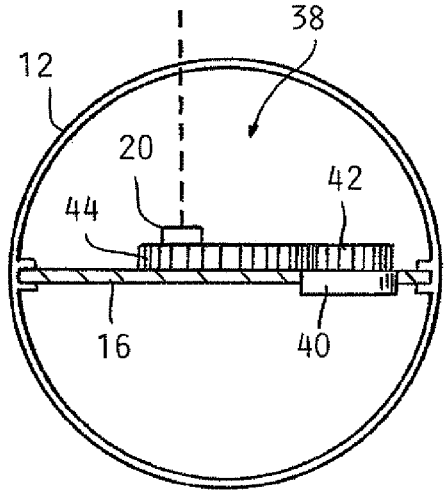
Figure 7:
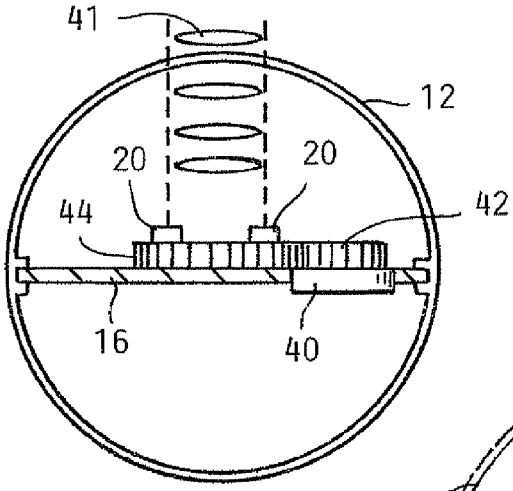
FIG. 7 is an end view of the housing of FIGS. 6A and 6B showing a distribution of light produced by the LEDs during oscillation.

An oscillator other than the MEMS 18 can be used. For example, FIG. 5 shows a MEMS 38 including a motor 40 attached to an aperture defined by the circuit board 16, a pinion gear 42 coupled to the motor 40, a spur gear 44 meshed with the pinion gear 42, and an LED 20 in a first position and a phantom LED 20 in a second position attached to the spur gear 44. Operating the motor 40 can cause the pinion gear 42 to rotate, which in turn can cause the spur gear 44 to rotate. Rotation of the spur gear 44 can move the LED 20 in a circular pattern, with the first and second positions of the LED 20 shown in FIGS. 6A and 6B. The MEMS 38 can cause the LED 20 to appear as a circular source of light as shown by a circular line 41 in FIG. 7 instead of a point source of light.

Figure 8:
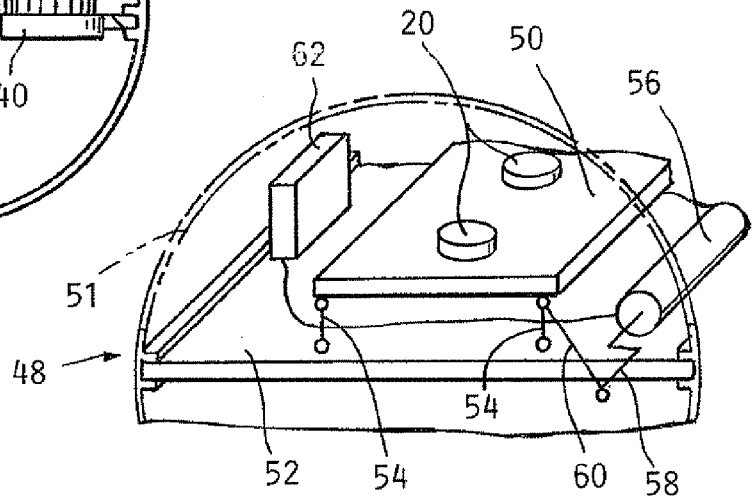
FIG. 8 is a partial schematic of yet another example of an oscillator.

Alternatively, structures other than microelectromechanical systems can be used as oscillators. For example, FIG. 8 shows a light 48 including a circuit board 50 pivotally mounted by a pair of levers 54 to a support 52 slidably engaged with a housing 51. Multiple LEDs 20 can be mounted on the circuit board 50. A motor 56 can be attached to the support 52, and a cam 58 can be coupled to the motor 56. The cam 58 can be coupled to the circuit board 50 by a link 60. Operation of the motor 56 can rotate the cam 58, and the link 60 can transmit motion from the cam 58 to the circuit board 50. As a result, the entire circuit board 50, as well as the LEDs 20 mounted thereon, can be oscillated. The motor 56 can be operated to rotate at a sufficient speed that the LEDs 20 move fast enough to produce a light blurring effect. Also, the levers 54, motor 56, cam 58, and link 60 can be large enough that they are not considered MEMS. For example, the motor 56 can be substantially larger than one of the LEDs 20.

Additionally, the light 48 in FIG. 8 can include a controller 62. The controller 62 can be in electrical communication the motor 56, and it can also be in electrical communication with a power source, such as the end caps 22. The controller 62 can control the rotational speed of the motor 56 by governing the current supplied to the motor 56. As a result, the controller 62 can control an oscillation frequency of the LEDs 20, which can alter the appearance of the light produced by the LEDs 20. The controller 62 can include a CPU and memory, and operation of the controller 62 can be controlled by a switch on the light 48, remotely, or internally by a program stored on the memory. Additionally, the controller 62 can be in communication with the LEDs 20 to vary the output of the LEDs 20 during operation, for example.

Figure 9:
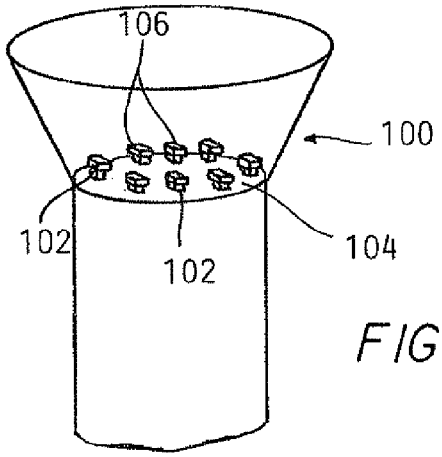
FIG. 9 is a partial perspective view of a flashlight.

While the above described embodiments illustrate the use of oscillators in lights shaped to replace fluorescent tubes, LEDs can also be mounted on oscillators in other types of light, such as vehicle lights, table lights, street lights, and lights designed to replace incandescent bulbs. As a further example, FIG. 9 illustrates a flashlight 100 including multiple MEMS 102 mounted on a base plate 104. The base plate 104 can be any type of support structure, for example a plastic piece beneath a lens of the flashlight 100. An LED 106 can be connected to each MEMS 102. The MEMS 102 can oscillate the LEDs 106, either by rotating the LEDs 106, translating the LED 106, moving the LEDs 106 using a combination of translation and rotation, moving a support structure to which all the LEDs 106 are connected, or otherwise moving the LEDs 106, in order to produce a light blurring effect. As a result, the flashlight 100 can produce light with a wide viewing angle.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. An LED-based light comprising:

a support structure;

a plurality of oscillators connected to and substantially evenly spaced along the support structure, the plurality of oscillators each including a microelectromechanical system;

a plurality of LEDs, wherein each of substantially all of the plurality of oscillators is coupled to at least one LED of the plurality of LEDs; and a light transmitting lens enclosing the plurality of LEDs;

wherein each microelectromechanical system is a smaller or a substantially similar size than its corresponding at least one LED and is operative in response to a current to continuously move the at least one LED between at least a first position and a second position during operation of the at least one LED at a sufficient speed to produce a light blurring effect; and wherein a light produced by the plurality of LEDs and transmitted through the lens is substantially uniformly distributed.

2. The LED-based light of claim 1, wherein a longitudinal axis of alight emitted from the at least one LED at the first position is at an angle with the longitudinal axis of the light emitted from the at least one LED at the second position.

3. The LED-based light of claim 1, further comprising:

a plurality of circuit boards, wherein each of least some of the plurality of oscillators is connected to at least one of the plurality of circuit boards for movement of the at least one circuit board relative to the support structure, and wherein the at least one LED is mounted on the circuit board for movement with respect to the support structure between the first position and the second position.

4. The LED-based light of claim 1, further comprising:

a tubular housing; and two pin-carrying end caps connected to opposing ends of the housing; with at least one of the end caps in electrical communication with the LEDs; and wherein the support structure includes a circuit board positioned in the tubular housing.

5. The LED-based light of claim 4 wherein at least one of the pin-carrying end caps is in electrical communication with the plurality of oscillators.

6. The LED-based light of claim 1, wherein the plurality of oscillators are evenly spaced along a length of the support structure.

7. The LED-based light of claim 1, wherein the plurality of oscillators are evenly spaced along a circumference of the support structure.

8. The LED-based light of claim 1, wherein at least one of the microelectromechanical systems includes a cam, a motor and a lever wherein:

the motor is coupled to the cam and operable to rotate the cam in response to the current and the lever is pivotally coupled between the cam and the support structure and operable to move the at least one LED between the first position and the second position upon rotation of the cam.

9. The LED-based light of claim 1, wherein at least one of the substantially all of the plurality of oscillators is coupled to a single LED.

10. A replacement light for a conventional fluorescent tube usable in a fluorescent fixture comprising:

a support structure;

a plurality of oscillators connected to the support structure, the plurality of oscillators each including a microelectromechanical system;

a plurality of LEDs, wherein each of substantially all of the plurality of oscillators is coupled to at least one LED of the plurality of LEDs;

wherein each microelectromechanical system is a smaller or a substantially similar size than its corresponding at least one LED and is operative in response to a current to continuously move the at least one LED between at least a first position and a second position during operation of the at least one LED at a sufficient speed to produce a light blurring effect between the first and second positions;

a light transmitting lens enclosing the at least one LED, wherein alight produced by the plurality of LEDs and transmitted through the lens is substantially uniformly distributed about the lens; and at least one electrical connector at a longitudinal end of the support structure in electrical communication with the at least one LED.

11. The LED-based light of claim 10, wherein a longitudinal axis of a light emitted from the at least one LED at the first position is at an angle with the longitudinal axis of the light emitted from the at least one LED at the second position, a line of light forming between the axes; and wherein lines of light produced by the plurality of LEDs are aligned such that the light produced by the plurality of LEDs substantially uniformly distributed along a longitudinal length of the light.

12. The LED-based light of claim 11, wherein the lens is configured to radially distribute the lines of light produced by the plurality of LEDs.

13. The LED-based light of claim 10, further comprising:

a plurality of circuit boards, wherein each of at least some of the plurality of oscillators includes at least one of the plurality of circuit boards for movement of the at least one circuit board relative to the support structure, and wherein the at least one LED is mounted on the circuit board for movement with respect to the support structure between the first position and the second position.

14. The LED-based light of claim 10, wherein the at least one electrical connector is further in electrical communication with the plurality of oscillators.

15. The LED-based fight of claim 10, wherein the support structure includes a circuit board; and wherein the at least one electrical connector includes a pair of pin-carrying end caps.

16. A method of distributing light produced by a plurality of LEDs in an LED-based light usable in a fluorescent fixture, the method comprising:

providing a plurality of microelectromechanical systems;

connecting each of substantially all of the plurality of microelectromechanical systems to at least one of the plurality of LEDs;

mounting the plurality of microelectromechanical systems along a support structure; and providing electrical connections to permit powering of the plurality of microelectromechanical systems during operation to continuos oscillate the plurality of LEDs at a sufficient speed to produce a light blurring effect during operation;

wherein the plurality of LEDs are positioned about the support structure in a sufficient number such that a substantially uniform and non-directional light is produced by the plurality of oscillating LEDs.

17. The method of claim 16, further comprising enabling the angle of orientation of the plurality of LEDs to change during their operation.

18. The method of claim 16, wherein providing electrical connections comprises:

providing electrical connections to permit power of the plurality of microelectromechanical systems and the plurality of LEDs by a common power source.

19. The method of claim 16, further comprising:

providing a controller configured to vary an oscillation frequency of the at least one microelectromechanical system.

20. The method of claim 16, further comprising:

providing a microelectromechanical motor configured to drive the microelectromechanical system.

* * * * *